US005372348A

United States Patent [19]

Cheng

[11] Patent Number: 5,372,348

[45] Date of Patent: Dec. 13, 1994

[54] STRUCTURE OF AN INCLINED BOOK HOLDER

[76] Inventor: Chung-Pu Cheng, Suite 1, 11F, 95-8 Chang Ping Road Sec. 1, Taichung, Taiwan, Prov. of China

[21] Appl. No.: 889,075

[22] Filed: May 19, 1992

[51] Int. Cl.[5] ..... A47B 97/04

[52] U.S. Cl. ..... 248/447.2; 248/460; 248/462; 248/231.7; 248/911

[58] Field of Search ..... 248/441.1, 447.2, 457, 248/460, 462, 225.3, 231.2, 231.3, 231.7, 231.8, 911

[56] References Cited

U.S. PATENT DOCUMENTS

| | | | |
|---|---|---|---|
| 160,044 | 2/1875 | Wilson | 248/447.2 X |
| 1,026,506 | 5/1912 | Hard | 248/447.2 X |
| 1,247,525 | 11/1917 | Gonnella | 248/462 |
| 2,046,134 | 6/1936 | Ryang | 248/462 X |
| 2,235,367 | 3/1941 | Heausler | 248/447.2 X |
| 2,445,606 | 7/1948 | Davis | 248/231.8 |
| 3,099,101 | 7/1963 | Burris | 248/447.2 |
| 4,023,101 | 6/1977 | Immordino | 248/231.3 |
| 4,620,687 | 11/1986 | Bishop | 248/447.2 |
| 5,016,852 | 5/1991 | Herendeen | 248/447.2 X |

FOREIGN PATENT DOCUMENTS

| | | | |
|---|---|---|---|
| 434504 | 9/1935 | United Kingdom | 248/462 |

*Primary Examiner*—Rinaldi I. Rada
*Assistant Examiner*—Clark F. Dexter

[57] ABSTRACT

An inclined book holder comprises a crenelated metal strip having an inclined support bar and a roughly S shaped clamping portion adjoined therewith, a pair of lateral members selectively positionable along the support bar, and a cross member also adjustably positionable therealong. The S shaped clamping portion defines a pair of opposed clamps carrying a pair of thumbscrews engaged through respective upper and lower plates thereof. A plurality of holes are formed along the support member for the positioning of the lateral members and cross member. The pivot ends of each lateral member is releasably securable to a selected hole on the support member using a nut and bolt. The cross member can likewise be positioned on the support member with an adjustable orientation therewith.

9 Claims, 5 Drawing Sheets

STRUCTURE OF AN INCLINED BOOK HOLDER

BACKGROUND OF THE PRESENT INVENTION

The present invention relates to a holder for books and similar articles that are generally rectangular in form, and more particularly to a holder which facilitates the support of such articles from an edge portion of a desk or table or from an elevated surface such as a shelf with the article being held in an inclined orientation with respect to a user.

Though various forms of book holders are known from the prior art, most comprise relatively flimsy foldable wire or sheet stock frames that are best suited for supporting relatively small books or which can only accomodate books whose dimensions fall within a narrow range. As the holders themselves rest over a table or the like no firm securement is provided therefor, and more significantly space on the tabletop which would otherwise be available for other uses becomes occupied. Furthermore, conventional forms of book holders usually do not provide a means of support from an elevated platform and are useable only from a horizontal surface such as a table or desk top.

It was in light of these deficiencies of the more conventional forms of book holders that the present invention was accomplished, in order to provide a more versatile book holder that can accomodate books or other articles of widely varying dimensions and which can support the articles from an elevated surface as well as over a tabletop, while still being fully collapsible for efficient storage.

SUMMARY OF THE PRESENT INVENTION

The present invention has as a main object to provide a book holder having an S shaped clamping member that defines respective opposed clamps for securement with a projecting surface such as an edge portion of a desk or an elevated shelf, and which has an elongate support member that adjoins with the clamping member at an acute angle.

A further object of the present invention is to provide a book holder further characterized in having at least one elongate auxiliary member that is selectively positionable along the support member and which can be varied in angular orientation therewith.

A yet further object of the present invention is to provide a book holder as characterized which further includes thumbscrews which are threadedly engageable with cooperating holes formed in upper and lower clamping portions of the clamp member so as to enable the rigid securement of a projecting surface within either clamp therein.

A still further object of the present invention is to provide a book holder that is easily folded or disassembled so as to facilitate the storage thereof.

Another object of the present invention is to provide a book holder of greater versatility that can be used with books or other articles of varied dimensions, and which can support the articles at selectable orientations with respect to a user.

Further objects and advantages of the present invention as well as the details of their actualization will become apparent by reference to the detailed description of the preferred embodiments thereof provided below along with accompanying drawings.

FIG. *2a* is a side view showing the clamp portion of the inclined book holder with the lower clamp thereof clamping an edge portion of a table.

FIG. *2b* is a side view showing the clamp portion of FIG. *2a* with the upper clamp thereof clamping an opposing edge portion of a table.

FIG. *2c* is a side view showing the clamp portion of FIG. *2a* inverted with the lower clamp thereof clamping an elevated edge portion of a shelf.

FIG. *2d* is a side view showing the clamp portion of FIG. *2a* with the lower clamp thereof clamping an edge portion of a table with the aid of an external wedge.

FIGS. *3a* and *3b* are side views showing a cross member and a pair of lateral members of the book holder respectively attached to a support member thereof.

Figure 4:
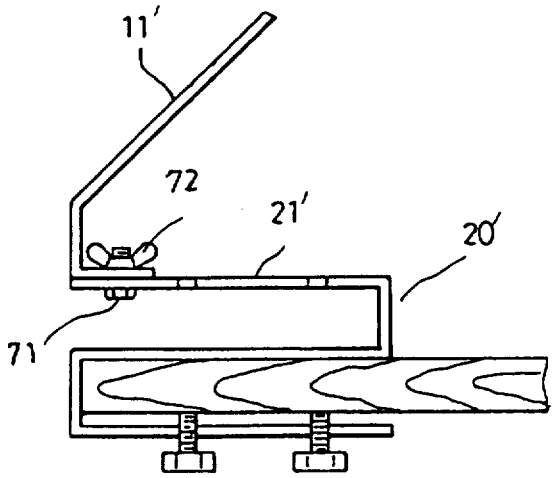

FIG. 4 is a side view of an alternate embodiment of the inclined book holder having a pivoting support bar.

DETAILED DESCRIPTION OF THE PREFERRED EMBODIMENTS

Figure 1:
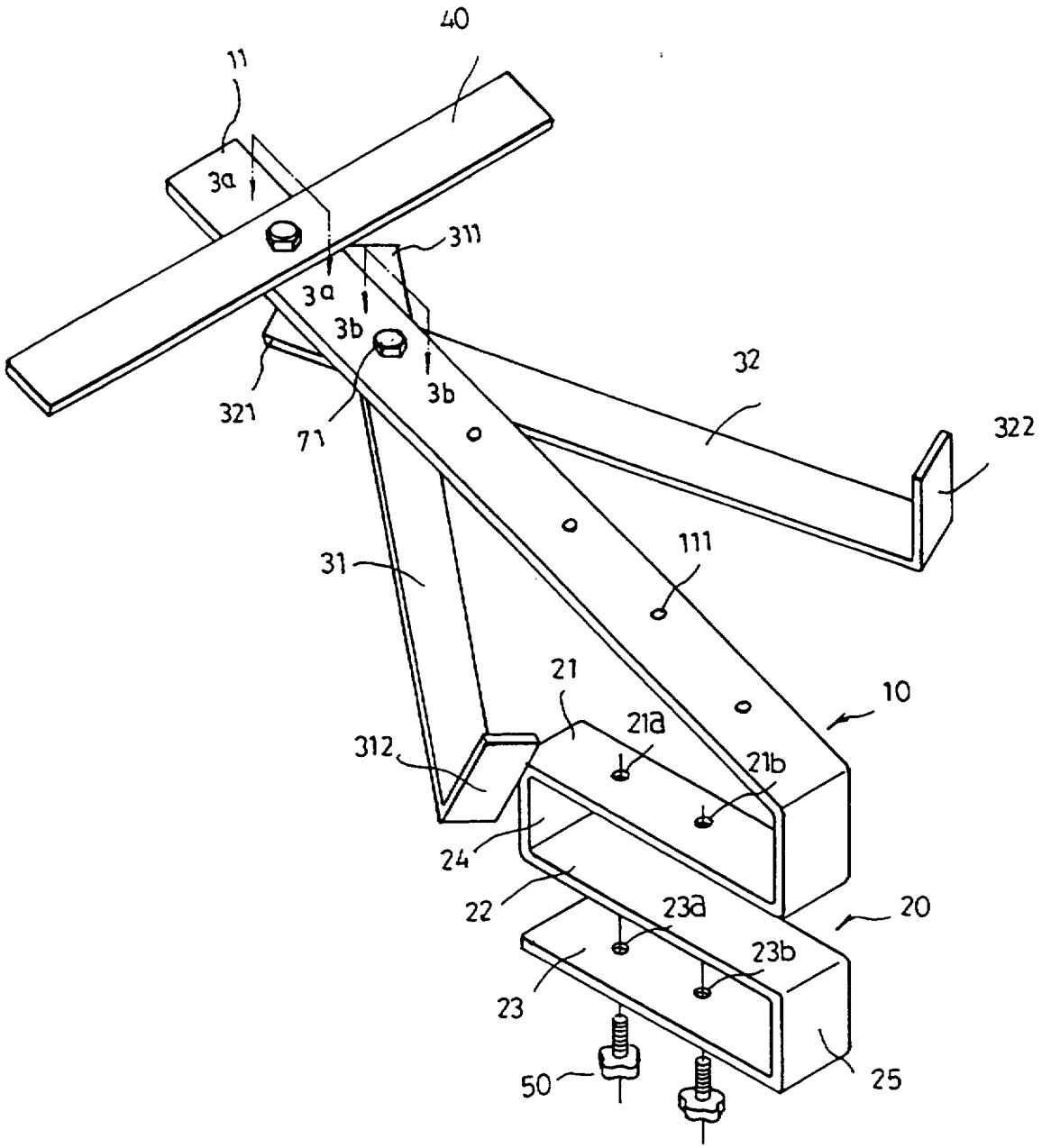
FIG. 1 is a perspective view of a first embodiment of the inclined book holder.

Referring to FIG. 1 of the drawings, a first embodiment of the inclined book holder of the present invention comprises a crenelated metal strip 10 having an inclined main support bar 11, a pair of lateral members 31,32 selectively positionable along the support bar, and a swivelable cross member 40 also adjustably positioned thereon.

The elongate support bar 11 adjoins with a roughly S shaped clamp portion 20 on the lower end thereof. Clamp portion 20 comprises an upper clamp plate 21, a parallel medial clamp plate 22, and a parallel lower clamp plate 23, with clamp plates 21,22 and 22,23 being joined by respective juncture plates 24 and 25 at opposing rear and front edges thereof. The support bar 11 adjoins with the front edge of clamp plate 21 and defines a roughly 45 degree angle therewith. A pair of thumbscrews 50 provided with the holder can be engaged through a pair of threaded holes **21*a*,21*b* on plate 21 or a similar pair 23*a*,23*b* on plate 23**.

Figure 2A:
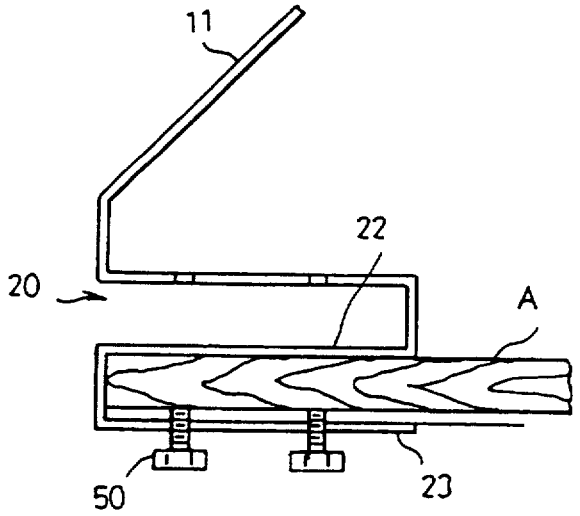
Figure 2B:
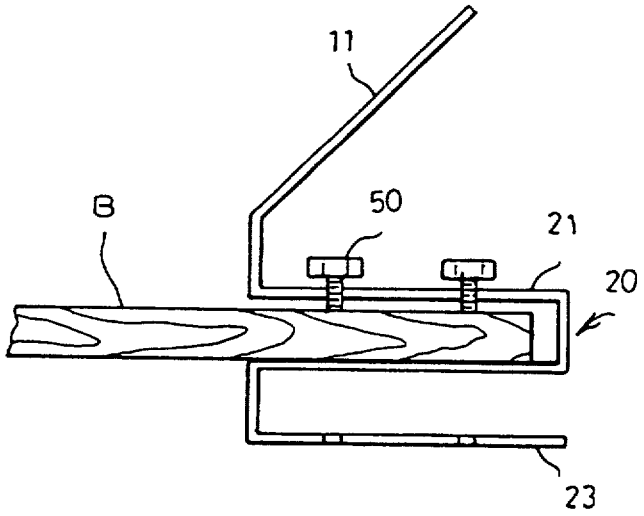
Figure 2C:
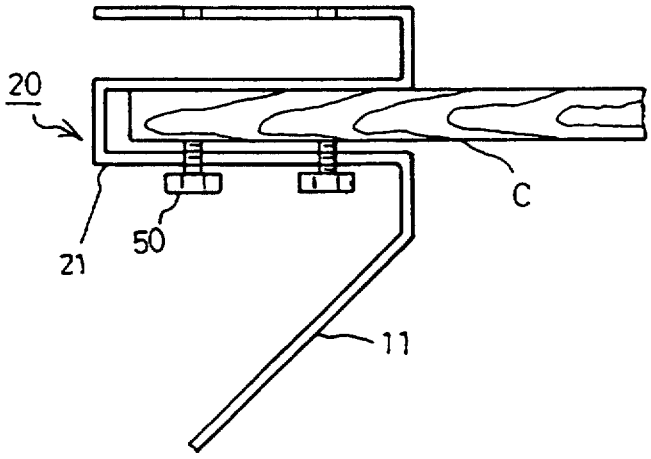
Figure 2D:
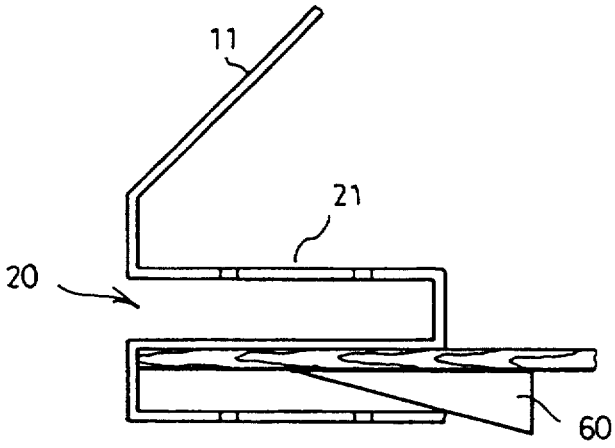
Figure 3B:
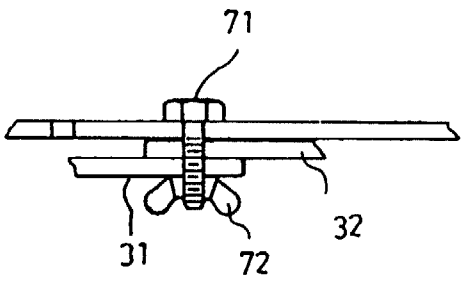
Figure 3A:
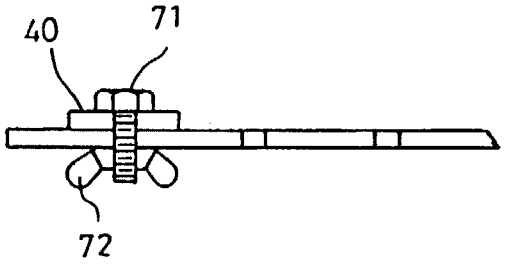

Note that all directional references described herein, such as front, rear, upper and lower, are with respect to the depictions in the drawings for purposes of greater clarity and should not be construed as limitations on the orientation of the book holder or any of its members. FIGS. *2a* to *2c* show the use of clamp portion 20 in clamping the book holder onto an edge of a desk or the like, or from an elevated surface such as a shelf. As can be seen, the book holder can be clamped over a proximal edge portion A of a table, with respect to a user situated adjacent therewith, by first sliding the clamp portion thereon over edge A so that the edge is between clamp plates 22,23 and then rotating thumbscrews 50, which are positioned in the lower plate, until they press tightly against the lower surface of edge A. The book holder is similarly clamped to a distal edge portion B across the table from the user by inserting the edge between clamp plates 21,22 and tightening the thumbscrews, which are now positioned in the upper plate below the support bar, thereagainst. When clamped to a shelf board C or other elevated ledge, the projection is clamped between plates 21,22 with the thumbscrews being positioned in the inverted plate 21 which is below the shelf board where they can be easily accessed. A resilient wedge 60 is further provided in order to facilitate the rapid clamping of relatively thin edges or boards, as shown in FIG. 2*d*, wherein the wedge is usable between either pair of clamp plates.

Referring again to FIGS. 1 and to 3, the pair of lateral members 31,32 and the cross member 40 are each attached to support bar 11 by a respective pairs of oblate bolts 71 and wing nuts 72. A plurality of holes 111 are formed at predetermined intervals along the support bar so that the lateral members and cross member can be selectively positioned thereon to accomodate books or other articles of varying dimensions. The pivot ends 311,321 of the lateral members are secured to one of the holes 111 using a nut and bolt 71,72 with each member spread apart at a substantial angle so as to support a lower edge of a book near the corners thereof with upturned brackets 312,322 formed on the opposing ends thereof. The central portion of cross member 40 is similarly secured to one of the holes 111 which is usually higher than the one carrying the lateral members and is usually swung into a perpendicular orientation with respect to the support bar to support the back of the book. Both the lateral members 31,32 and the cross member 40 can be selectively positioned at any of the holes 111 with the lateral members and cross member usually being disposed on opposite sides of the support bar 11 so that they can be swung into alignment or near alignment with the support member without interference. Storage of the book holder is thus greatly facilitated.

An alternate embodiment of the book holder is shown in FIG. 4, wherein a separate support bar 11' is pivotably attachable to the clamp portion 20'.

The lower end of support bar 11' is securable with a forward portion of clamp plate 21' using a nut and bolt 71,72 similar to those used with the lateral and cross members. The support bar could thus be pivoted about the clamp plate by first loosening the securing nut and re-tightening after the support bar and a supported article were moved to desired orientation with respect to a user. As with the members carried on the support bar of both embodiments, the bar 11' can be separated from the members connected therewith to facilitate compact storage of the book holder.

Many further variations and refinements to the present invention not described in the present disclosure could also be accomplished by a person of average skill in the art without departing from the scope thereof. For example, provision could be made for further appendages on either or both the cross member and lateral members, such as spring clamps or the like, so as to facilitate the retainment of various articles or parts thereof, such as artboards, the pages of a book, etc. Similarly, further cooperating members could also be added thereon to enable a sliding engagement on the support bar so as to be infinitely adjustable. Furthermore, the clamp portion can also be modified to effect a better engagement with various seating surfaces by adding one or more elements thereto, or even simplified by eliminating the thumbscrews if the clamp plates were provided with sufficient resilience to directly clamp a surface.

Hence, the exact spirit and scope of the present invention should not be inferred from the specificities of the exemplary embodiments thereof provided above, but instead should be determined from the appended claims and their legal equivalents.

I claim:

1. An inclined holder comprising:

a roughly S-shaped clamping member including an upper clamping plate, a medial clamping plate, and a lower clamping plate, said upper and medial clamping plates, and said lower and medial clamping plates, respectively, defining openings in said S-shaped clamping member for insertion of a projecting surface, and clamping means for securing the projecting surface in one of said openings to secure said inclined holder to said Ser. No. 07/889,075 (Cheng) Complying Amemdment, Cont. projecting surface;

an elongate support member, an end portion of said support member being adjoined with said upper clamping plate, and said support members extending at an acute angle with respect to a plane containing said upper clamping plate; and two rigid elongate auxiliary members, and means on said support member for selectively positioning said two elongate auxiliary members at one of a plurality of predetermined positions along a length of said support member, said means for selectively positioning including an attaching means for pivotally attaching said auxiliary members to said support member at said one predetermined position for adjustable orientation therebetween.

2. The inclined holder according to claim 1, wherein said clamping means is at least one thumbscrew, and the upper and lower clamping plates each has at least one threaded hole formed therein, said at least one thumbscrew being threaded through one of said threaded holes for securing said projecting surface in one of said clamp openings.

3. The inclined holder according to claim 1, wherein said clamping means is a resilient wedge element disposed within at least one of said clamp portions for securing said projecting surface in one of said clamp openings.

4. The inclined holder according to claim 1, wherein said end portion of said support member is pivotably adjoined with said upper clamping plate by a pivot connection.

5. The inclined holder according to claim 4, wherein said pivot connection is a releasable mechanical fastener.

6. The inclined holder according to claim 1, wherein said means for selectively positioning said two elongate auxiliary members includes a plurality of holes aligned along said support member, said holes defining said predetermined Ser. No. 07/889,075 (Cheng) Complying Amemdment, Cont. positions, and said attaching means being engaged in one of said holes.

7. The inclined holder according to claim 6, wherein said attaching means is a mechanical fastener.

8. The inclined holder according to claim 1, wherein each of said rigid elongate auxiliary members is pivotally attached at a first end to said support member, and has a second end provided with an upturned bracket.

9. The inclined holder according to claim 1, further includes a cross member releasably and pivotably secured at a medial position of said cross member to said support member at one of said predetermined positions by a mechanical fastener.

* * * * *